United States Patent [19]

Sargent

[11] 4,378,114

[45] Mar. 29, 1983

[54] BILLIARD TABLE BALL SEPARATOR

[75] Inventor: Alfred E. Sargent, Hardin, Mont.

[73] Assignee: Montana Billiard Supply, Billings, Mont.

[21] Appl. No.: 267,683

[22] Filed: May 28, 1981

Related U.S. Application Data

[63] Continuation-in-part of Ser. No. 38,677, May 14, 1979, abandoned.

[51] Int. Cl.[3] ..... A63D 15/00

[52] U.S. Cl. ..... 273/11 C

[58] Field of Search ..... 273/10, 11 R, 11 C

[56] References Cited

U.S. PATENT DOCUMENTS

| | | | |
|---|---|---|---|
| 3,115,341 | 12/1963 | Feddick et al. | 273/11 C |
| 3,339,922 | 9/1967 | Miller | 273/11 R |
| 3,439,915 | 4/1969 | Schweer | 273/11 R |
| 3,466,037 | 9/1969 | Miller | 273/11 C |
| 3,547,439 | 12/1970 | Feddick | 273/11 R |
| 3,967,821 | 7/1976 | Bagley | 273/11 C |
| 4,004,806 | 1/1977 | Malik | 273/11 R |
| 4,015,845 | 4/1977 | Sines | 273/11 C |
| 4,116,435 | 9/1978 | Sines et al. | 273/11 R |

FOREIGN PATENT DOCUMENTS

| | | | |
|---|---|---|---|
| 1478244 | 4/1969 | Fed. Rep. of Germany | 273/11 R |

*Primary Examiner*—Richard C. Pinkham
*Assistant Examiner*—T. Brown
*Attorney, Agent, or Firm*—Arthur L. Urban

[57] ABSTRACT

A billiard table having a playing surface, a plurality of pockets associated with the playing surface, ball collecting mechanism below the playing surface for transferring balls entering the pockets into a common channel, cue ball separating mechanism including a light emitter disposed along one edge of the common channel, a light sensor disposed along the edge of the common channel closely adjacent to and at a point in the ball path beyond the light emitter for distinguishing between the intensity of light reflected from a cue ball and the remaining billiard balls, an electrical deflecting device in the common channel at a point in the ball path beyond the light sensor, and electrical circuitry connecting the light emitter, the light sensor and the electrical deflecting device.

10 Claims, 7 Drawing Figures

BILLIARD TABLE BALL SEPARATOR

This application is a continuation-in-part of pending application Ser. No. 38,677, filed May 14, 1979 (abandoned).

This invention relates to a novel pocket billiard table and more particularly relates to a new billiard table for commercial establishments.

In recent years, there has been a major increase in the popularity of pocket billiards. This revival has been both in the home and especially in billiard lounges and other commercial establishments. Commercial billiard tables not only have to be sturdily constructed to take heavy use and abuse normally encountered in such use, but also the tables advantageously incorporate features to accommodate the different playing conditions of commercial establishments.

For example, it is desirable that commercial billiard tables be coin operated so that the participants can begin play without becoming involved with the proprietor or a member of his staff. Another feature which is desired is the retention of the balls when play is completed. This eliminates supervision to determine when the game is completed and also reduces problems that might otherwise occur such as loss of balls, if the balls remain loose in the pockets or collection chutes.

One of the complications in providing for the retention of the balls is taking care of the situation in which the cue ball inadvertently enters one of the pockets, that is, if the player "scratches". The cue ball must be retrievable so play can continue until the game is completed. This requires that the table include some type of mechanism to provide for the separation of the cue ball from the other balls so that it can be retrieved without permitting access to the other balls on which play is completed.

A number of different mechanisms have been proposed to allow retrieval of the cue ball if a player scratches during play. One table utilizes a cue ball which is a different size from that of the other balls. This size variation enables the cue ball to be separated from the others by gauging the size of each ball as it moves to a collecting station. The smaller balls pass through the gauge while a larger size cue ball is diverted along a different path to a spot where it is accessible for reuse.

Another table employs a cue ball with magnets molded therein. The balls move past a magnetic detector as they are transferred to a collecting station. As the cue ball passes the detector, the magnets within the cue ball activate the detector which is connected to a mechanical deflecting device that separates the cue ball from the other balls.

Although changing the size or magnetic character of the cue ball provides a means for separating the cue ball from the others so it will be available for resuse, these alterations change the play of the game to a degree. While the change in play may be considered to be very slight by less skillful players, more skilled players may be conscious of the difference. While it might be shown scientifically that the cue ball behaves the same as the other balls, some players may be affected psychologically with the result that their shooting suffers. In any case, experienced players realize that professionals use cue balls that are the same as the other balls, so playing with an altered cue ball gives them an excuse if they do not play up to their expectations.

In an attempt to provide billiard players with a commercial table which uses a cue ball that is the same as the other balls, one table design utilizes a plurality of light detectors spaced around a selected point in the path of the balls as they move to a collection station. The system employs circuitry to determine if all of the detectors are recording a high light intensity. If so, this condition would indicate that a cue ball was passing. Suitable separating devices then are activated to divert the cue ball to a support where it is available for use again.

While this table design provides a mechanism for separating a cue ball from other billiard balls of the same size and character, it has not gained wide acceptance. One of the shortcomings of the design is the complexity of the system. In addition, the plurality of detectors requires considerable time and effort to set up and calibrate the system. Thus, it is apparent than none of the presently available billiard tables offer the ideal combination of features, price and ease of installation desired by commercial operators.

The present invention provides a novel commercial billiard table which allows the use of a cue ball that is the same size and character as the other balls. The billiard table of the invention provides a unique mechanism for separating the cue ball from the other balls. Thus, the balls may be collected and retained as play with each is completed while still leaving the cue ball available if a player scratches.

The present invention also provides a novel billiard table which retains the cue ball after play has been completed with all of the other balls. In addition, the invention provides a billiard table in which all electrical circuitry is deenergized automatically when play is finished.

The cue ball separating apparatus of the invention is simple in design. Also, the ball separating mechanism is convenient to install and calibrate. Furthermore, the ball separating apparatus has a high degree of reliability and requires little maintenance. In addition, the ball separating apparatus can be fabricated from commercially available components.

Other benefits and advantages of the novel billiard table of the present invention will be apparent from the following description and the accompanying drawings in which.

Figure 1:
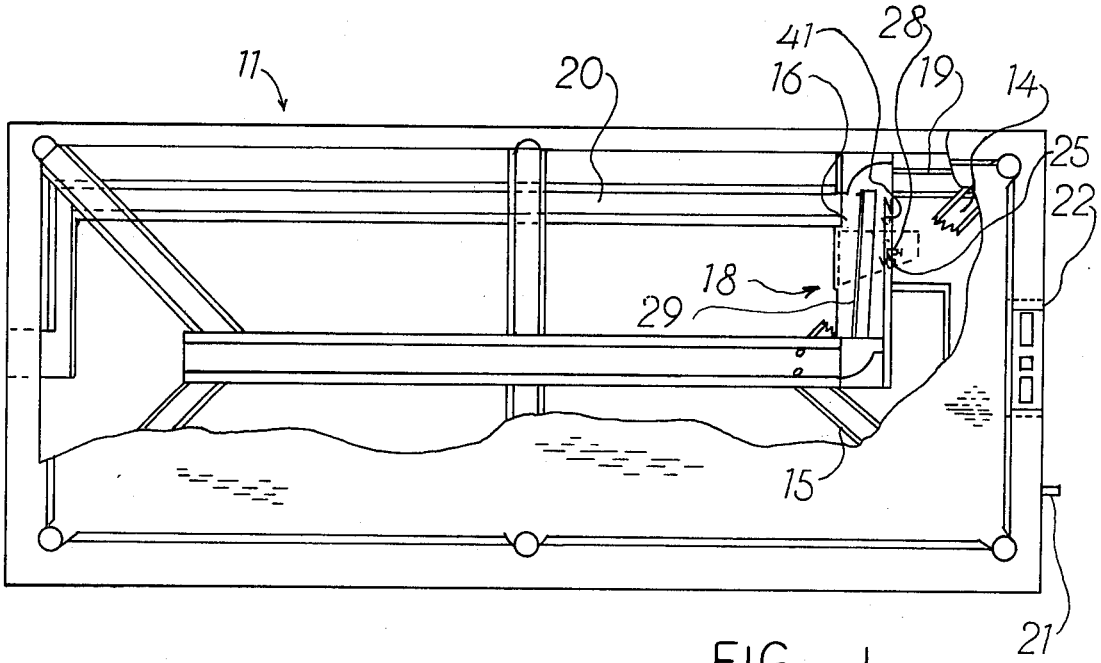
FIG. 1 is a top view of one form of the novel pocket billiard table of the invention partially in section.

As shown in the drawings, one form of the novel pocket billiard table of the present invention includes a frame 11 with a playing surface 12. A plurality of pockets 13 are located at the corners of the playing surface 12 and at the midpoint of the longer sides of the table. Ball collecting means shown as tracks 14 and 15 are located below the playing surface. The tracks 14 are positioned to transfer balls entering the pockets 13 onto a central track 15 and then to a common channel 16 where a cue ball separating apparatus 18 is disposed along one edge thereof. At the end of channel 16 beyond the ball separating apparatus 18 is a ball collecting tray 19. In addition, a cue ball track 20 extends from channel 16 at the cue ball separating apparatus 18 to a point in the frame 11 at the periphery of the table, preferably remote from a coin chute 21 and a ball access opening 22.

Figure 2:
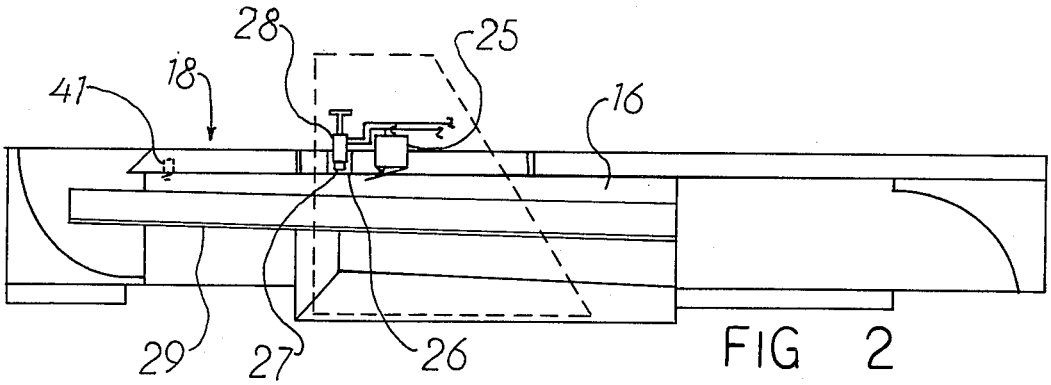
FIG. 2 is an enlarged fragmentary top view of one form of the cue ball separating apparatus of the billiard table shown in FIG. 1.
Figure 3:
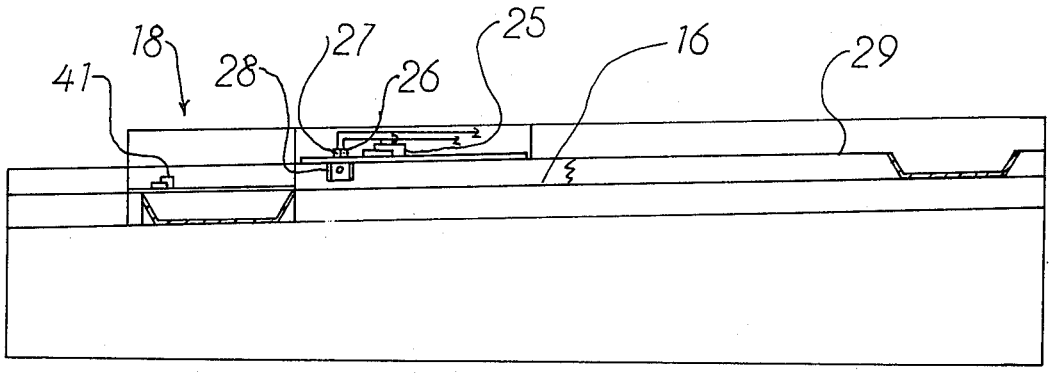
FIG. 3 is a side view of the cue ball separating apparatus shown in FIG. 2.
Figure 4:
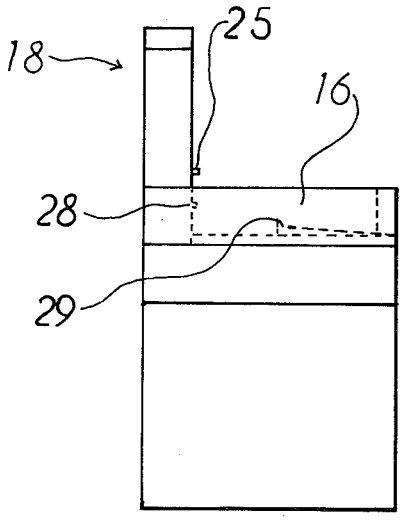
FIG. 4 is a left end view of the cue ball separating apparatus shown in FIGS. 2 and 3.

The cue ball separating apparatus 18 of the invention as shown in greater detail in FIGS. 2–4 includes a ball contacting switch 25 disposed along channel 16. A light emitter 26 also is disposed along channel 16 at a point in the ball path beyond the ball contacting switch 25 with a light sensor 27 disposed along the channel 16 just beyond the light emitter. An electrical deflecting device such as solenoid 28 is disposed along the channel 16 at a point in the ball path beyond the light sensor 27 adjacent the intersection of cue ball track 20 with channel 16.

The light emitter 26 may be a commercially available unit of the type which is capable of emitting a beam of light across the path of the balls in channel 16. The light emitted may be of a desired wave length either in the visible or invisible range. Advantageously, the light emitter 26 is an infrared light emitter.

The light sensor 27 obviously is of a type which senses the particular wave length range of the light emitter 25. Advantageously, the emitter 26 and sensor 27 are closely spaced with a short focal length. This arrangement enables the emitter and sensor to be positioned closely to the surface of the balls passing along channel 16, e.g. less than about one inch away and preferably less than about one-half inch away. Combining the emitter 26 and sensor 27 into a unitary structure facilitates positioning of the unit very close to the surface of the passing balls in the channel 16.

Figure 5:
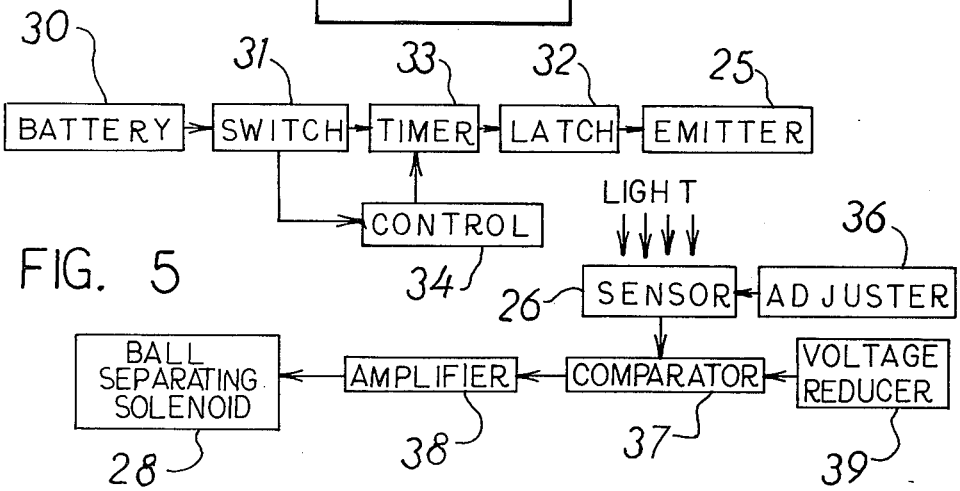
FIG. 5 is a block diagram of circuitry for the cue ball separating apparatus of the billiard table of the invention.

Circuitry of the cue ball separating apparatus 18 of the billiard table of the invention is shown in block diagram form in FIG. 5. The circuitry shown in FIG. 5 provides for the separation of the cue ball from the fifteen numbered balls. As shown, the circuitry includes an electrical power source 30, preferably a battery, and a ball contacting switch 31. Latching means 32 maintains light emitter 26 in an energized state with timing means 33 controlling the timing interval in which latching means 32 energizes the light emitter.

Control means 34 also is associated with timing means 33. Control means 34 is responsive to each pulse from ball contacting switch 31 to ensure that the timing pulse transmitted by timing means 33 to latching means 32 provides a full operating interval for each ball if additional balls contact switch 31 prior to the completion of a prior interval. Such a situation may occur if more than one ball falls into the pockets in a single shot. In this case, the balls may enter channel 16 from tracks 14 and 15 in a closely spaced relationship and may contact switch 31 prior to the completion of the time interval for the preceding ball.

The circuitry (FIG. 5) of the cue ball separating apparatus 18 of the invention further includes adjusting means 36 associated with light sensor 27. Adjusting means 36 selectively establishes a threshold voltage level of the output voltage from the sensor. Analog comparing means 37 compares the output voltage transmitted by sensor 27 with a reference voltage. The pulses from the analog comparing means 37 are amplified by amplifying means 38 and passed to electrical deflecting means (solenoid 28) to activate it.

Advantageously, voltage reducing means 39 are provided to significantly reduce and stabilize the reference voltage transmitted to analog comparing means 37. This reduction in the reference voltage, e.g. to approximately 1.2 volts provides a constant and stabilized voltage level over a longer period than would be possible if the circuit depended upon normal battery voltage levels which deteriorate with use.

Figure 6:
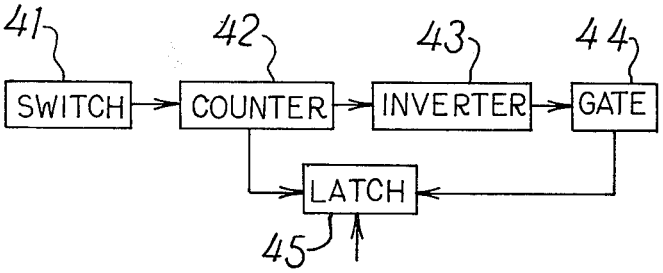
FIG. 6 is a block diagram of circuitry for controlling the operation of the cue ball separating apparatus when play is completed.

The circuitry shown in the block diagram of FIG. 6 controls the operation of the cue ball separating apparatus 18 to retain the cue ball after play has been completed with all fifteen of the numbered balls. Until all fifteen numbered balls have been pocketed, the cue ball will continue to be separated for reuse. This circuitry includes a second ball contacting switch 41 disposed along the channel 16 at a point in the ball path beyond the solenoid 28 and the intersection of the cue ball track 20 with the channel.

Pulse counting means 42 is responsive to pulses from the second switch 41. Decoding means is responsive to signals from the pulse counting means 42. Advantageously, the decoding means may include pulse inverting means 43 to invert pulses from the counting means 42 and transmit them to gate means 44. Latching means 45 receives pulses from counting means 42 and also from gate means 44.

When the proper combination of pulses is received by latching means 45, the cue ball separating apparatus 18 is deactivated. The proper combination of pulses will be received by latching means 45 when all fifteen numbered balls have passed second switch 41. With the separating apparatus 18 deactivated, the cue ball moving along channel 16 will not be deflected by solenoid 28 but will continue along channel 16 and be captured in ball collecting tray 19.

Figure 7:
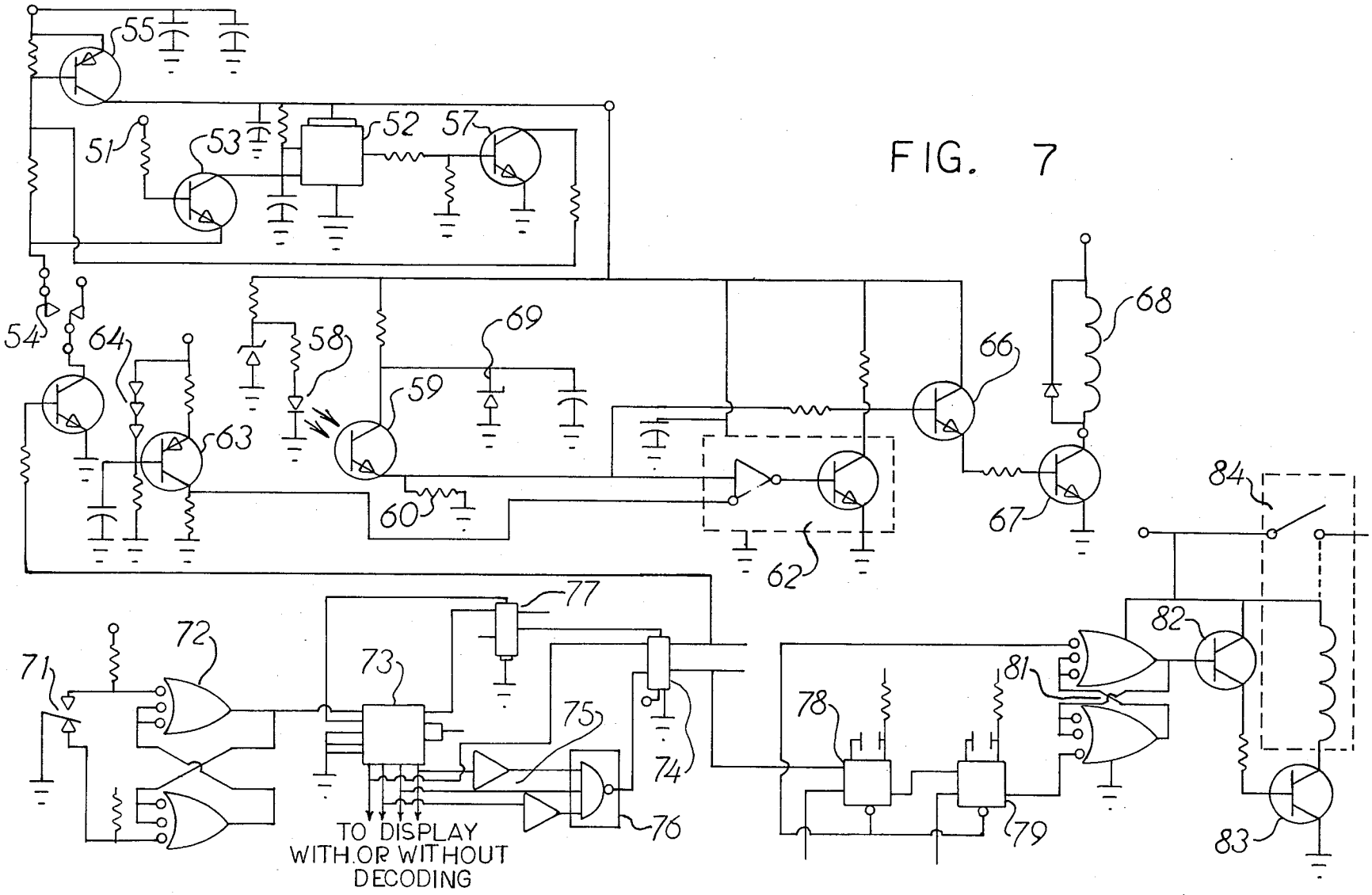
FIG. 7 is a detailed diagram of one form of circuitry for the cue ball separating apparatus of the billiard table of the invention.

A preferred form of circuitry for the billiard table of the present invention is illustrated in the diagram shown in FIG. 7. As shown, a battery 51 supplies an electrical current to a timer 52 through transistor 53. Timer 52 is also connected to a ball count switch 54 through another transistor 55. Latch 57 is connected to timer 52 to energize light emitter 58.

Light sensor 59 disposed closely adjacent to light emitter 58 has an adjustment potentiometer 60 which establishes a threshold voltage selectively for the output voltage from sensor 59. Analog comparator 62 receives the output voltage from sensor 59 and compares it with a reference voltage from a voltage reducing and stabilizing circuit including transistor 63 and diodes 64. Advantageously, the reference voltage is maintained at a constant voltage of approximately 1.2 volts.

If the output voltage from sensor 59 is greater than the reference voltage, the comparator 62 will transmit pulses to transistors 66 and 67 for amplification to activate solenoid 68 which deflects the cue ball from common channel 16 onto track 20. Zener diode 69 protects sensor 59 against voltage variations.

To control the operation of the cue ball separating apparatus 18 so that the cue ball will be captured after play has been completed with all of the other balls, additional circuitry includes a second ball count switch 71 disposed at a point in the ball path beyond the solenoid 68. Pulses from the switch 71 are received by gate 72 and then transmitted to counter 73. Pulses from counter 73 pass to latch 74 directly as well as through inverter 75 and gate 76. Other pulses from counter 73 pass to latch 74 through another latch 77.

When latch 74 receives a sufficient number of pulses indicating that fifteen balls have passed switch 71, timers 78 and 79 will deactivate gate 81 and transistors 82 and 83 after a selected interval to open relay 84 and thereby deenergize the entire circuit. With the circuitry deenergized, when the cue ball passes the emitter 58 and sensor 59, the circuitry will not activate solenoid 68 so the cue ball will not be deflected but instead will enter the ball storage tray 19 and be retained with the numbered balls until the circuitry of the table is again energized for a new game.

In the operation of the cue ball separating apparatus of the billiard table of the invention, balls shot into pockets 13 pass down tracks 14 and 15 to common channel 16. As the balls advance along the common channel, they pass light emitter 26. Light emitted from emitter 26 bounces off each ball and is reflected back to sensor 27. If the output voltage from the sensor 27 exceeds a threshold level established by calibrating the sensor with adjusting potentiometer 60 (FIG. 7), solenoid 28 will be activated by comparator 62. The adjusting potentiometer 60 provides for the establishment of an output voltage level which causes the intensity of the light of the white cue ball to activate comparator 62 with amplified pulses therefrom being transmitted to the cue ball deflecting solenoid. The solenoid 28 will deflect the cue ball from channel 16 onto the cue ball return track 20.

On the other hand, when a colored numbered ball or one with white striping passes by the light sensor 27, the intensity of light received by the light sensor is less than the threshold voltage. Since the threshold voltage level of sensor 27 is not exceeded when balls other than the cue ball pass the sensor, solenoid 28 will not be activated and the balls will advance along the channel 16 into a ball collecting tray 19 where they will be stored. After all fifteen balls pass switch 71, the circuitry will be deenergized after an interval determined by timers 78 and 79. Then, when the cue ball passes the solenoid, it is not deflected and will advance along channel 16 and be collected in ball tray 19 with the other balls.

To facilitate separation of a cue ball with the cue ball separating apparatus 18 of the billiard table of the invention, common channel 16 advantageously includes a longitudinal knife edge 29 extending upwardly from the bottom of the channel. As shown in FIGS. 2–4, the knife edge 29 extends along the channel 16 adjacent the cue ball separating solenoid 28. The utilization of the knife edge 29 as a balancing line for the balls passing along channel 16 significantly reduces the force required from solenoid 28 to deflect the cue ball from channel 16 onto track 20.

The above description and the accompanying drawings show that the present invention provides a novel commercial billiard table that permits a cue ball to be used which is the same size and character as other balls. Furthermore, the billiard table of the invention provides a novel apparatus for separating the cue ball from the other balls, such as when a player scratches.

The present invention also provides a novel billiard table that is capable of retaining the cue ball with the other balls when play is completed. In addition, the billiard table provides for the deenergizing of all of the circuitry automatically when play is finished.

Another advantage of the novel billiard table of the invention is the simplicity of its design. Also, the cue ball separating apparatus of the billiard table of the invention is convenient to calibrate by simply placing a cue ball in front of the light emitter and sensor and adjusting the potentiometer or other adjusting component associated with the sensor to the appropriate threshold voltage. This adjustment causes the sensor to transmit a sufficiently high output voltage only when the cue ball passes the sensor and not when the numbered balls pass by. Under this condition, the comparator 37 energizes the solenoid 28 through appropriate amplifiers to deflect the cue ball while allowing the numbered balls to advance to the ball collecting tray 19.

It will be apparent that various modifications can be made in the particular billiard table design and the cue ball separating apparatus thereof described in detail above and shown in the drawings within the scope of the invention. For example, the configuration and size of certain components can be changed to meet specific requirements. Also, elements of the circuitry can be combined into integrated circuit chips or microprocessor units. In addition, other billiard game features can be added provided they are compatible with the circuitry and structure of the billiard table of the invention and do not deleteriously affect its operation. Therefore, the scope of the invention is to be limited only by the following claims.

What is claimed is:

1. A billiard table having a playing surface for use with a set of conventional billiard balls, a plurality of pockets associated with said playing surface, ball collecting means below said playing surface for transferring balls entering said pockets into a common channel, cue ball separating means including light emitting means disposed along one edge of said common channel, light sensing means disposed along said edge of said common channel closely adjacent to and at a point in the ball path beyond said light emitting means, said light sensing means being capable of distinguishing the intensity of light reflected from a cue ball from the intensity of light reflected from any other ball of the set electrical deflecting means along said common channel at a point in the ball path beyond said light sensing means, electrical circuitry connecting said light emitting means, said light sensing means and said electrical deflecting means; said circuitry including an electrical power source, ball contacting switch means disposed along said common channel at a point in the ball path prior to said light emitting means, latching means for maintaining said light emitting means in an energized state, timing means controlling the time interval in which said latching means energizes said light emitting means, control means responsive to each pulse from said ball contacting switch means associated with said timing means to ensure a full operating interval of said latching means for each ball if additional balls contact said switch means prior to the completion of a prior interval, adjusting means to selectively establish a threshold level of the output voltage from said light sensing means, analog comparing means for comparing the output voltage from said light sensing means with a reference voltage, means for amplifying pulses transmitted from said analog comparing means to electrical deflecting means, whereby when the output voltage exceeds said reference voltage, pulses from said analog comparing means energize said deflecting means and remove only said cue ball from said common channel.

2. A billiard table according to claim 1 wherein said common channel includes a longitudinal ball balancing knife edge extending upwardly from the bottom thereof adjacent said electrical deflecting means.

3. A billiard table according to claim 1 wherein said electrical power source of said circuitry is a storage battery.

4. A billiard table according to claim 1 wherein said electrical deflecting means of said circuitry is a solenoid.

5. A billiard table according to claim 1 wherein said circuitry includes power level stabilizing means associated with said light sensing means.

6. A billiard table according to claim 1 wherein said circuitry includes means for significantly reducing and stabilizing the reference voltage transmitted to said analog comparing means.

7. A billiard table according to claim 1 wherein said circuitry includes second ball contacting switch means disposed along said common channel at a point in the ball path beyond said electrical deflecting means, pulse counting means responsive to pulses from said second switch means, decoding means responsive to signals from said pulse counting means, latching means connected to said pulse counting means, said latching means selectively deenergizing said cue ball separating means when play is completed.

8. A billiard table according to claim 7 wherein said circuitry includes pulse conditioning means to control the transmission of pulses from said second ball contacting switch means to said pulse counting means.

9. A billiard table according to claim 7 wherein said circuitry includes signal inverting means for inverting signals from said pulse counting means and gate means responsive to signals from said inverting means.

10. A billiard table according to claim 7 wherein said circuitry includes decoding means and display means associated with said pulse counting means.

* * * * *